US005678577A

United States Patent [19]

Matsumura et al.

[11] Patent Number: 5,678,577

[45] Date of Patent: Oct. 21, 1997

[54] TOBACCO FILTER MATERIAL AND A TOBACCO FILTER AS PRODUCED USING THE SAME

[75] Inventors: Hiroyuki Matsumura; Syu Shimamoto; Tohru Shibata, all of Himeji, Japan

[73] Assignee: Daicel Chemical Industries, Ltd., Osaka, Japan

[21] Appl. No.: 550,640

[22] Filed: Oct. 31, 1995

[30] Foreign Application Priority Data

Oct. 31, 1994 [JP] Japan ..... 6-292148
Oct. 31, 1994 [JP] Japan ..... 6-292149

[51] Int. Cl.[6] ..... B01D 27/00

[52] U.S. Cl. ..... 131/331

[58] Field of Search ..... 131/331, 332, 131/345

[56] References Cited

U.S. PATENT DOCUMENTS 4,283,186 8/1981 Keith et al. ..... 131/345 X
5,365,951 11/1994 Arterbery et al. ..... 131/342 X

FOREIGN PATENT DOCUMENTS

B-44-1944 1/1944 Japan .
B-44-1953 1/1944 Japan .
44-1953 1/1969 Japan .
A-52-72900 12/1975 Japan .
B-50-38720 12/1975 Japan .
A-52-96208 8/1977 Japan .
A-53-45468 4/1978 Japan .
A-55-141185 11/1980 Japan .
A-5-227939 9/1993 Japan .

*Primary Examiner*—Jennifer Bahr
*Attorney, Agent, or Firm*—Cushman Darby & Cushman IP Group of Pillsbury Madison & Sutro, LLP

[57] ABSTRACT

A tobacco filter is produced by wrapping up a sheet-like filter material having a web structure and comprising a cellulose ester short staple into a rod-form. As the cellulose ester short staple, a short staple that is non-crimped and/or has a modified cross section where a ratio D1/D2 of a diameter D1 of the circumscribed circle to a diameter D2 of the inscribed circle, each circle being of the cross section, of not less than 2 is used. The short staple includes e.g. a cellulose acetate fiber with an average fiber length of 1 to 10 mm and fineness of 1 to 10 deniers. The short staple may be incorporated with a beaten pulp with a Schopper-Riegler freeness of 20 to 90° SR and/or a binder. The ratio of the short staple to the beaten pulp may for example be about 90/10 to 20/80 (by weight).

19 Claims, 2 Drawing Sheets

TOBACCO FILTER MATERIAL AND A TOBACCO FILTER AS PRODUCED USING THE SAME

FIELD OF THE INVENTION

The present invention relates to a tobacco filter material with very satisfactory wet disintegratability and efficient elimination of harmful components of tobacco smoke and insuring good aroma and palatability of tobacco smoke, a tobacco filter as produced using the filter material which has an adequate firmness in addition to the above-mentioned characteristics and contributory to mitigation of environmental pollution, and a tobacco provided with the tobacco filter.

BACKGROUND OF THE INVENTION

As a tobacco filter which removes tars from the tobacco smoke and insures a satisfactory smoking quality, a filter plug prepared by shaping a tow (fiber bundle) of cellulose acetate fibers with a plasticizer such as triacetin is generally used. In this filter, the constituent filaments have been partly fused together by the plasticizer to be shaped so that the filter plug has an adequate firmness. Thus, use of such filter minimizes deformation of the filter when held in a smoker's mouth and does not impart unpleasantness to the smoker. By the same token, however, when such filter is discarded after smoking, it takes a long time for the filter plug to disintegrate itself in the environment, thus adding to the pollution problem.

Meanwhile, a tobacco filter made of a creped paper manufactured from a wood pulp and a tobacco filter made from a regenerated cellulose fiber are also known. Compared with a filter plug comprising a cellulose acetate fiber, these filters are slightly more wet-disintegratable and, thus, of somewhat lower pollution potential. However, in these filters, not only the aroma and palatability of tobacco smoke are sacrificed but the efficiency of selective elimination of phenols which is essential to tobacco filters can hardly be expected.

Japanese Patent Application Laid-open No. 96208/1977 (JP-A-52-96208) discloses a sheet consisting of an acetylcellulose pulp prepared in a specified manner and short staples of a thermoplastic resin. However, because this sheet is manufactured by mix-webbing the pulp and short staples and heating the resulting paper under pressure, it is high in tensile strength and elongation after immersion in water as well as in water resistance and very low in disintegratability.

Japanese Patent Publication No. 1953/1969 (JP-B-44-1953) discloses a tobacco filter which is manufactured by shaping a paper into a rod-shape. In this filter, the paper is prepared by using crimped acetate fibers having a fiber fineness of 2 to 5 deniers and fiber length of 3 to 10 mm and other beaten stuff (stock) for paper or a binder, and as examples of the beaten stuff or stock, there is mentioned a beaten pulp having a degree of beating SR of about 10 to 15. This literature mentions that such tobacco filter insures good smoking quality and filtration properties (elimination properties) of tobacco smoke. The tobacco filter has, however, a little firmness or hardness so that it is deformed when held in a smoker's mouth. Thus, such deformation imparts unpleasant feeling to the smoker as well as deteriorates filtration properties as essentially required of tobacco filters. Further, the tobacco filter as produced using crimped acetate fibers has low dispersibility in water and, hence, low environmental degradability. Moreover, such raw material is hardly fabricated into a web (paper) so that manufacturing processes of the filer becomes complicated.

Meanwhile, a binder or plasticizer may be incorporated into tobacco filters to emphasize firmness or hardness of the filters. Such filters, however, will occasionally be high-costed, or the smoking quality or wet disintegratability of the same will be sacrificed.

SUMMARY OF THE INVENTION

It is, therefore, an object of the present invention to provide a tobacco filter material which does not detract from the aroma, taste and palatability of tobacco smoke, and elimination properties of harmful components of tobacco smoke, and which is highly wet disintegratable and, hence, contributory to mitigation of the pollution problem, and a tobacco filter as produced using the filter material.

It is another object of the present invention to provide a tobacco filter material which provides excellent smoking quality and eliminating properties of harmful components of tobacco smoke, and is useful for imparting an adequate firmness to a tobacco filter, and a tobacco filter as manufactured using the same.

A further object of the invention is to provide a tobacco filter material which further provides excellent wet disintegratability and, hence alleviates the pollution burden on the environment and a tobacco filter using the same material.

It is still another object of the present invention to provide a tobacco filter material which disintegrates itself readily and fast when wetted despite its great dry strength and a tobacco filter as produced using the filter material.

Another object of the present invention is to provide a tobacco which insures excellent aroma, taste and palatability of tobacco smoke and is highly disintegratable in the environment, and, hence, minimizes the environmental pollution problem.

It is a yet another object of the present invention to provide a tobacco which has an adequate firmness and hence provides a comfortable smoking feeling (sensation when smoked) and insures excellent aroma, taste and palatability and high elimination efficiency of harmful components of tobacco smoke.

It is a still further object of the present invention to provide a tobacco which is highly disintegratable in the environment and hence contributory to mitigation of the pollution problem.

The inventors of the present invention did an intensive research to accomplish the above-mentioned objects, and found that a tobacco filter as produced using a tobacco filter material in the form of a sheet having a web structure and comprises, as a main component, a cellulose ester short staple having a certain ratio or more of a diameter of a circumscribed circle relative to a diameter of an inscribed circle both in the cross section of the fiber and, if necessary, a beaten pulp, a binder or other component insures excellent smoking quality and elimination efficiency of harmful components of tobacco smoke, provides an adequate firmness (hardness) which is essential to tobacco filters and disintegrates or degrade itself rapidly on contact with water such as rain water in the environment.

They also found that a tobacco filter which is manufactured using a tobacco filter material in the form of a sheet having a web structure and comprising a non-crimped cellulose ester short staple insures excellent aroma, taste and palatability and provides high elimination efficiency of harmful components of tobacco smoke and disintegrates itself on contact with rain water or others in the environment. The present invention has been accomplished based on these findings.

Thus, the present invention relates to a tobacco filter material which is in the form of a sheet having a web structure and comprises a cellulose ester short staple (hereinafter may occasionally be referred to as sheet material), wherein the cellulose ester short staple is;

(1) a cellulose ester short staple having a modified cross section, wherein the ratio of a diameter D1 of a circumscribed circle relative to the diameter D2 of an inscribed circle, each circle being of the cross section of the short staple, is such that the former D1/the latter D2 is not less than 2, (2) a non-crimped cellulose ester short staple or (3) a non-crimped cellulose ester short staple having a modified cross section, wherein the ratio D1/D2 is not less than 2.

The ratio of the diameter D1 of the circumscribed circle and the diameter D2 of the inscribed circle may be such that D1/D2 is 2.2 to 6. The sectional configuration of the cellulose ester may include various modified cross sections which satisfy or gratify the above-mentioned value, for example, X-, Y-, H- or I-configuration. The cellulose ester may be an ester with an organic acid having 2 to 4 carbon atoms, for example, a cellulose acetate, and the average degree of substitution of the cellulose ester may be about 1.5 to 3.0. The cellulose ester short staple may practically have an average fiber length of about 1 to 10 mm and a fiber fineness of about 1 to 10 deniers.

The tobacco filter material in the form of a sheet may comprise a beaten pulp in addition to the cellulose ester short staple. The proportion of the cellulose ester short staple to the beaten pulp may practically be about 90/10 to 20/80 (by weight). The degree of beating of the beaten pulp may be a Schopper-Riegler freeness of about 20 to 90° SR, and the beaten pulp may for example be a wood pulp or the like. The filter material in the form of a sheet may further contain a binder in addition to the cellulose ester short staple or to the cellulose ester short staple and the beaten pulp. Further, the sheet-like tobacco filter material may optionally be creped or embossed. Practically, the filter material has a web structure obtainable by wet webbing (web-formation).

The tobacco filter of the present invention comprises the tobacco filter material as wrapped or rolled up into the shape of a rod. The tobacco according to the present invention is provided with the above-mentioned tobacco filter.

It should be understood that the term "circumscribed circle of the cross section of the fiber (circumscribed circle)" as used in this specification means a minimum circle that is capable of completely including or covering the cross section of the fiber, and the term "inscribed circle of the cross section of the fiber (inscribed circle)" as used herein means a maximum circle that is capable of being completely included or covered by the cross section. The term "cross section of the fiber" as used in this specification means and includes a cross section in the orthogonal direction (at right angle) to the axial direction of the fiber. It should be understood that the term "sheet" as used in this specification means any paper-like entity having a two-dimensional expanse that can be taken up in the form of a roll.

DETAILED DESCRIPTION OF THE INVENTION

Figure 1:
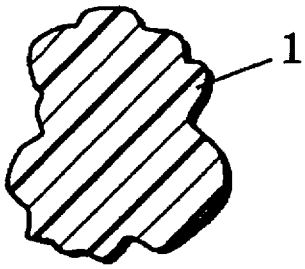
FIG. 1 is a cross sectional view showing an example of a fiber having an R-configured cross section.

The cellulose ester used in the present invention includes, for example, organic acid esters such as cellulose acetate, cellulose butyrate, cellulose propionate, etc.; inorganic acid esters such as cellulose nitrate, cellulose sulfate, cellulose phosphate, etc.; mixed acid esters such as cellulose acetate propionate, cellulose acetate butyrate, cellulose acetate phthalate, cellulose nitrate acetate, etc.; and cellulose ester derivatives such as polycaprolactone-grafted cellulose acetate and so on. These cellulose esters can be used singly or in combination.

The average degree of polymerization (e.g. viscosity-average degree of polymerization) of the cellulose ester may for example be about 10 to 1,000, preferably about 50 to 900 and more preferably about 200 to 800.

The preferred example of the cellulose ester includes organic acid esters (for example esters with an organic acid having about 2 to 4 carbon atoms), among which a cellulose acetate is particularly desirable. While the average degree of substitution of cellulose ester is generally in the range of about 1 to 3, use of those species with average degrees of substitution in the range of about 1 to 2.15, preferably about 1.1 to 2.0, provides an improved high biodegradability and hence is useful for minimizing the pollution burden on the environment. Therefore, the degree of substitution of the cellulose ester may suitably be selected from the range of about 1 to 3 but use of a cellulose acetate having an average degree of substitution in the range of about 1.5 to 3.0 (e.g. about 2 to 3) is desirable.

Cellulose esters in which the equivalent ratio of residual alkali metal or alkaline earth metal to residual sulfuric acid is about 0.1 to 1.5 and preferably about 0.3 to 1.3 (e.g. about 0.5 to 1.1) has excellent heat resistance and biodegradability. The sulfuric acid is derived from the sulfuric acid used as a catalyst in the production of the cellulose ester. The sulfuric acid includes not only the free acid but also the sulfate salt, sulfoacetate and a sulfuric acid ester that may remain in the cellulose ester. The alkali metal (e.g. lithium, sodium, potassium, etc.) and the alkaline earth metal (for example, magnesium, calcium, strontium, barium and so on) is added as a neutralizer for the catalyst sulfuric acid as well as for the purpose of enhancing the thermal resistance of cellulose esters. Meanwhile, as for the equivalent ratio of residual alkali metal or alkaline earth metal to residual sulfuric acid, U.S. patent application Ser. No. 08/151,037 may be referred to.

The cellulose ester fiber (short staple) may be a fiber formed with one or more species of the cellulose esters, or a fiber formed with a mixture of the cellulose ester and other component (for example, a thermoplastic resin). In the latter case, the fiber may preferably comprise the cellulose ester in a proportion of not less than 50% by weight based on the total weight of the fiber.

A feature of the present invention resides in that in the sheet material comprising a cellulose ester short staple, the cellulose ester short staple has a specific modified cross section and/or is non-crimped.

That is, the present invention is characterized, in one aspect, in that the cellulose ester short staple has a modified cross section and that the diameter D1 of the circumscribed circle and the diameter D2 of the inscribed circle both of which are of the cross section of the fiber has a specified relationship. Use of the sheet material comprising such cellulose ester fiber insures effectively high firmness or rigidity of the tobacco filter and provides high elimination efficiency or other filtration properties.

Figure 2:
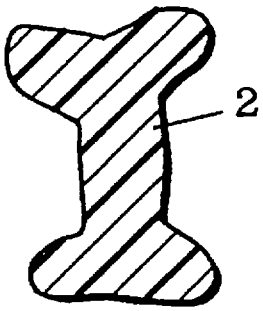
FIG. 2 is a cross sectional view illustrating an example of a fiber having an I-configured cross section.
Figure 3:
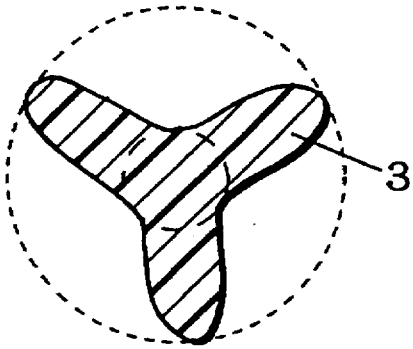
FIG. 3 is a cross sectional view showing an example of a fiber having a Y-configured cross section.
Figure 4:
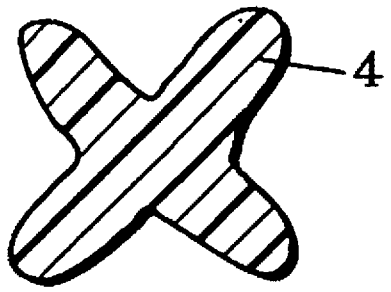
FIG. 4 is a cross sectional view illustrating an example of a fiber having an X-configured cross section.
Figure 5:
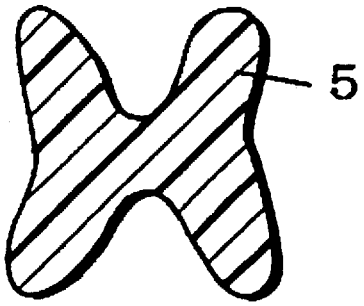
FIG. 5 is a cross sectional view illustrating an example of a fiber having an H-configured cross section.

When the cellulose ester fiber is manufactured by spinning, the cross section of the fiber can be adjusted or modified to a variety of shapes according to a shape or arrangement of a nozzle. Such cross sectional configurations include round (circular), as well as a variety of modified or irregular configurations such as oval (elliptical), triangle, rectangle, trefoiled, cross, reniform, R-, H-, I-, T-, U-, V-, Y-, X-, or star-configuration, or hollow. As for examples of fibers having modified cross sections, the fiber with the R-configured cross section include, for example, a fiber 1 having a cross section as illustrated in FIG. 1. Example of the fibers of the I-configured cross section includes a fiber 2 with a cross section as shown in FIG. 2. As examples of the fibers with Y-configured cross section, those with X-configured cross section and those with H-configured cross section, there may be mentioned a fiber 3, a fiber 4 and a fiber 5 each having a cross sections as illustrated in FIGS. 3, 4 and 5, respectively. Meanwhile, in FIG. 3, the inner circle as indicated by a broken line illustrates the inscribed circle of the cross section of the fiber, and the outer circle as indicated by a dotted line shows the circumscribed circle of the cross section.

The cross sectional configuration of the cellulose ester fiber is not specifically restricted as far as being a modified cross section where the ratio R of the diameter D1 of the circumscribed circle relative to the diameter D2 of the inscribed circle is not less than 2. Preferred fiber may practically be a fiber having a cross section that can be manufactured in a comparatively easy manner such as X-, Y-, H- or I-configured cross section. Such preferred fibers include fibers having Y-, X-, H-configured cross section. A fiber with Y-configured cross section may practically be used. The fibers of species having the preferred modified cross sections such as X- or Y-cross section have not so extremely complicated structures as compared with fibers with other modified cross sections so that they are advantageous in production. Further, the sheet as produced using such fiber may not be too much bulky and hence the sheet material can be wrapped up or rolled up to form a filter without cutting the sheet due to decrease of the sheet strength.

In the present invention, the ratio R of the diameter D1 of the circumscribed circle of the cross section of the fiber (circumscribed circle) relative to the diameter D2 of the inscribed circle of the cross section (inscribed circle) may be such that the former D1/the latter D2 is in the rage of not less than 2, preferably about 2.2 to 6, more preferably about 2.3 to 5 and particularly about 3 to 5. Use of the fiber having a modified cross section where the ratio R of the diameter D1 of the circumscribed circle relative to the diameter D2 of the inscribed circle within the above-mentioned range imparts suitable or proper bulkiness and elasticity (resiliency) to the filter. Therefore, a tobacco filter manufactured by using the filter material provides an enhanced firmness or hardness and provides a greater surface area per unit volume and, hence, it insures improved smoking quality and filtration properties.

The cellulose acetate short staple having a modified cross section may be whichever of a crimped or non-crimped fiber, but is preferably used in the non-crimped form for enhancing the wet disintegratability, as mentioned hereinbelow.

The present invention is characterized, in another aspect, in that the cellulose ester is in the form of a short staple and non-crimped. In the present specification, the term "fiber which is non-crimped (hereafter may simply referred to as non-crimped fiber)" includes, within the meaning thereof, not only a fiber being completely or absolutely linear or straight but also a curved or bent fiber. Such curved or bent fiber includes, for instance, a somewhat curbed fiber having a ratio of the actual size (exact size) relative to the distance (interval) between the both ends of the fiber is such that the former/the latter is not more than about 4/3 (preferably not more than about 5/4). Such fiber is capable of easily modifying its shape to straight or linear-form by means of, for example, a slight shear force (shearing force) due to water stream in water. Preferred example of the non-crimped fiber includes a fiber in the straight or linear form.

The non-crimped fiber may be obtainable by spinning technique such as dry spinning, wet spinning, melt spinning or others without crimping process, as well as by releasing or relieving the crimping of fibers. Namely, in the tobacco filter made of a fiber bundle (tow) of ordinary cellulose acetate fibers, crimped cellulose acetate fibers are employed for being advantageous in manufacturing and transportation and for improving the elimination efficiency of harmful components of tobacco smoke. Further, by the same reason, the above-mentioned Japanese Patent Publication No. 1953/1969 (JP-B-44-1953) mentions that the cellulose acetate as the constituent material of the paper should necessarily be crimped fibers. Such crimped fibers, however, are apt to be entangled or interlaced each other and low in dispersibility in water so that the fibers may hardly be fabricated into a sheet, in particular by wet webbing, and the resultant filter material may practically be low in the disintegratability in the environment. Accordingly, in the non-crimped cellulose ester short staple, crimped cellulose ester fibers as the raw material (for example fibers for manufacture of a conventional tobacco filter composed of a cellulose acetate fiber bundle) may be used as elongated fibers obtainable by releasing or relieving treatment of the crimping of the raw material fiber. As a technique to release the crimping of the fibers, there may be mentioned a technique which comprises allowing a tensile force to act on the raw material fiber with heating through a heating means such as steam. While use of the non-crimped fiber tends to sacrifice the filtration or eliminating efficiency, such decrease of the filtration efficiency may be prevented by incorporation of other component such as a beaten pulp which has been beaten to an appropriate extent.

In the non-crimped fiber, the cross sectional configuration of the fiber is not specifically restricted and may for example be circular, elliptical or any other configurations as exemplified above. Incidentally, for imparting an adequate firmness or hardness to tobacco filters, the fiber having a modified cross section can advantageously be employed.

The cellulose ester short staple used in the present invention may be at least (1) the fiber having a modified cross section and the specified ratio R of the diameter D1 relative to the diameter D2 or (2) the non-crimped fiber, but preferred examples of the cellulose ester short staple include (3) fibers which are non-crimped and have a modified cross section and the specified ratio R of the diameter D1 relative to the diameter D2. A tobacco filter material as produced using such fibers (3) further insures an adequate firmness of the tobacco filter and provides high wet disintegratability without deteriorating the smoking quality and eliminating efficiency of the harmful components of tobacco smoke.

According to the present invention, the cellulose ester in the form of a short staple is employed. The average fiber length of the cellulose ester short staple is not particularly restricted as far as not impairing the web-formability (webbing properties) or other properties of the material. By way of illustration, in case of preparing a sheet by means of a conventional wet webbing (web-formation) technique or in order to improve the disintegratability in the environment, the average fiber length is for example about 1 to 10 mm, preferably about 2 to 8 mm and practically about 3 to 7 mm. When the fiber length is too short, the cost for manufacturing the short staple is likely to be increased and the sheet strength tends to be sacrificed so that a trouble such as cutting of the sheet during the rolling up process may be occurred. Use of a fiber having an excessively long fiber length may sacrifice the dispersibility in water and, hence, a sheet can hardly be manufactured by wet webbing and the disintegratability is apt to be deteriorated.

Meanwhile, where such disintegratability is not required, or preparation of a non-woven sheet is conducted by a conventional dry web-formation technique, the fiber length of the cellulose ester fiber is not restricted within the above-mentioned range, and may for example be 10 mm or more.

The fiber diameter of the cellulose ester fiber is not specifically restricted as far as not interfering with the permeability (puffing properties), disintegratability and other properties of filters, and the fineness of the fiber may for example be about 1 to 10 deniers, preferably about 2 to 8 deniers and more preferably about 2 to 7 deniers. Such fiber having a fiber diameter of less than 1 denier requires a specified technique for spinning and can hardly be manufactured in a manner generally employed. On the other hand, if the fineness is greater than 10 denier, the filtration efficiency will be deteriorated and the strength of the sheet may be impaired or the bulkiness of the sheet may become excessively high and hence the material may hardly be rolled up or wrapped up.

The sheet-like tobacco filter material of the present invention may only be a sheet material having a web structure and comprising the cellulose ester short staple, while single use of such cellulose ester short staple, in particular the non-crimped short staple and no other, may deteriorate the self-adhesive properties and web-formability (paper-formability) and hence the sheet material can hardly be obtained practically. Therefore, the cellulose ester short staple may preferably be shaped into a sheet form together with a beaten pulp and/or a binder (for example, a binder comprising a naturally-occurring or synthetic resin). In a preferred embodiment, the cellulose ester short staple may practically be mix-webbed with at least the beaten pulp.

It should be understood that the term "beaten pulp" as used in this specification includes, within its meaning, a pulp comprising a naturally-occurring cellulose fiber such as a wood pulp, linter, hemp, etc., as well as a pulp made of a synthetic resin, each of which has been beaten with the use of a conventional beating machine (beater) or cracking machine. As the beaten pulp, a wood pulp obtainable from a soft wood or hard wood according to a conventional manner such as sulfite method, kraft method or other technique is practically employed. The beaten pulp is fibrillated by beating to possess or develop paper-making properties (paper-formability).

The degree of beating may be selected from a range insofar as not sacrificing the web-formability in a system comprising both of the cellulose ester short staple and the beaten pulp, and is for example such that the Schopper-Riegler freeness is in the range of about 10 to 90° SR (e.g. about 20 to 90° SR), preferably about 20 to 80° SR, more preferably about 25 to 75° SR. Practically, a beaten pulp having a Schopper-Riegler freeness of about 30 to 70° SR is employed. If the degree of beating is much too low, the entanglement or interlacing of fibers is not sufficient so that the cellulose ester short staples can hardly be adhered and hence the strength of the sheet is liable to be deteriorated. On the other hand, use of a beaten pulp having an excessively high degree of beating causes excessive binding force and adhering properties of fibers so that the disintegratability tends to be sacrificed.

The proportion of the cellulose ester short staple to the beaten pulp can suitably be selected from a range where the smoking quality, filtration properties for harmful components, paper-formability or other characteristics of the filter material are not adversely affected, and is for example such that the former/the latter is about 90/10 to 20/80 (by weight) and preferably about 80/20 to 20/80 (by weight). Desirably, the proportion of the cellulose ester short staple to the beaten pulp is such that the former/the latter is about 80/20 to 30/70 (by weight), preferably about 75/25 to 35/65 (by weight) and more preferably about 70/30 to 40/60 (by weight). When the proportion of the cellulose ester short staple is less than the lower limit, the aroma and palatability of tobacco smoke are sacrificed and the efficiency of selective elimination for phenols or the like is deteriorated. To the contrary, if the ratio of the beaten pulp is too low, the strength of the sheet tends to be decreased.

As described above, a naturally-occurring and/or a synthetic binder may be employed as necessary in the preparation of the sheet material of the present invention. In particular, when the content of the cellulose ester is comparatively high or the sheet is prepared in a non-woven form by dry technique, incorporation of a binder may occasionally be required to some extent. As the binder, there may be employed binders that do not adversely affect on human body (human organism) and not deteriorate the aroma and palatability of tobacco smoke and the filtration properties. Examples of binders which do not adversely affect on human body and not deteriorate the smoking quality and filtrating properties include binders belonging to food additives and being odorless. The amount of the binder is, for example, not more than 10% by weight (e.g. about 0.1 to 10% by weight) and preferably about 1 to 8% by weight (e.g. about 2 to 7% by weight) based on the total weight of the filter material. The binder may applied to the filter material in a conventional manner, for example by spraying an aqueous solution of the binder to the material.

When the wet disintegratability is required, a water-soluble binder (water-soluble adhesive) may advantageously be used. As the water-soluble binder, there may be mentioned, for example, natural adhesives such as a starch, a modified starch, a soluble starch, dextran, gum arabic, sodium alginate, casein and gelatin; cellulose derivatives such as carboxymethylcellulose, hydroxyethylcellulose and ethylcellulose; and synthetic resin adhesives such as polyvinyl alcohol, polyvinylpyrrolidone, a water-soluble acrylic resin and so forth. These water-soluble adhesives may be used alone or in combination.

Meanwhile, a non-water soluble (water-insoluble) binder in such a small amount that does not interfere with the disintegratability may be employed regardless of its water-insolubility. By similar to ken, a binder having an odor or smell may be utilized as far as not deteriorating the aroma, taste and palatability of tobacco smoke and not imparting unpleasant feeling to the smoker. Further, a plasticizer for the cellulose ester can be used within the range not sacrificing the disintegratability of the filter material.

The filter material is preferably creped or embossed for insuring a smooth and uniform passage of tobacco smoke through the filter plug (filter rod) without channeling. By wrapping up the creped or embossed filter material into a rod-like form, a filter plug having a homogeneous cross section and an attractive appearance can be obtained. By the creping or embossing, a filter having an adequate permeability (puffing properties) can be effected. By way of illustration, by the creping or embossing, there can easily be obtained a filter having a satisfactory permeability to tobacco smoke, for example having a pressure drop (puff resistance) of about 200 to 600 mm WG (Water Gauge or $H_2O$) and preferably about 300 to 500 mm WG (Aq) in the filter with a length of 10 cm and a diameter of 7.8 mm.

The creping can be effected by passing the sheet material through a pair of creping rolls formed with a multiplicity of grooves running in the direction of advance to thereby form winkles or creases and, to a lessor extent, fissures in the sheet along the direction of its advance. The embossing can be conducted by passing the sheet material over a roll formed with a grate or random relief pattern having convex and/or concave portions or pressing the sheet material with a roller formed with such a relief pattern.

The pitch and depth of the grooves for creping and the pitch and depth of the embossing pattern can be selected from the range of about 0.3 to 5 mm (e.g. about 0.5 to 5 mm) for pitch and the range of about 0.1 to 2 mm (e.g. about 0.1 to 1 mm) for depth.

The weight (weighing) of the sheet-like tobacco filter material is not particularly limited as far as the permeability and other properties of the filter material are not adversely affected, and is for example about 10 to 60 g/m$^2$, preferably about 15 to 45 g/m$^2$, more preferably about 20 to 40 g/m$^2$ and practically about 25 to 35 g/m$^2$. A sheet with a weight of less than 10 g/m$^2$ is very low in paper-formability, on the other hand, if the weight of the sheet exceeds 60 g/m$^2$, crepes will hardly be formed in a creping process in the manufacture of a paper filter so that heterogeneous gaps in the cross section of the filter tend to be formed.

The cellulose ester short staple and/or the filter material may comprise various additives. Examples of such additive include sizing agents; finely divided powers of inorganic substances including kaolin, talc, diatomaceous earth, quartz, calcium carbonate, barium sulfate, titanium dioxide and alumina; stabilizers such as thermal stabilizers including salts of alkaline earth metals (calcium, magnesium, etc.), antioxidants and ultraviolet ray absorbents; colorants; oils (textile oils or textile auxiliaries); and yield improvers. Furthermore, the environmental degradation of the filter material can be increased by incorporating an environmental degradation accelerator (biodegradation accelerator) such a citric acid, tartaric acid, malic acid and the like and/or a photo degradation accelerator such as an anatase-form titanium dioxide into the cellulose ester short staple. Such titanium dioxide including the anatase-form titanium dioxide may play a role as a whitening agent (whiteness improver) for the cellulose ester fiber.

The tobacco filter material of the present invention is composed of the above-mentioned constituent component(s) and in the form of a sheet having a non-woven web structure. The term "web structure" is used herein to mean a textural structure in which fibers are interlaced or entangled as in, for example, a sheet or Japanese paper obtainable by web-formation. For the above reason, the sheet-like tobacco filter material having a high dry paper strength and yet disintegrating itself rapidly when wetted with rain water or the like can easily be obtained in a field where disintegratability is required. Such tobacco-filter material is highly disintegratable and insures excellent filtration properties (e.g. elimination properties) of the harmful components of tobacco smoke and gratifying smoking quality (flavor, aroma, taste, palatability and so on). Further, the material provides an adequate or satisfactory firmness or hardness as required of tobacco filters and is highly disintegratable when wetted and hence reduces the risk of environmental pollution.

The sheet material may be manufactured by a conventional dry web-formation (paper-making) technique, for example, a technique comprising spraying the cellulose ester and, when necessary, other component such as the beaten pulp to a permeable support such as a net by means of air flow (air stream). Preferably, the filter material is manufactured by wet webbing technique with the use of a slurry containing the cellulose ester short staple and the beaten pulp, and, as necessary, the other component, all of which are dispersed in water. Therefore, preferred web structure includes a web structure obtainable by wet webbing (wet web-formation). The content of solid matters of the slurry can suitably be selected from a range as far as a paper can be formed, and is for example about 0.005 to 0.5% by weight. The webbing can be effected according to a conventional manner, for example in a technique comprising fabricating the slurry to form a paper with the use of a wet paper-making machine provided with a perforated panel or other equipment, and dehydrating and drying the resultant web.

The tobacco filter material of the present invention is useful for the manufacture of tobacco-smoke filters (tobacco filter rods or plugs). The tobacco filter mentioned above comprises the sheet material which has been rolled up or wrapped up into the form of a rod (particularly a rod with a round cross section). The sheet material is rolled up or wrapped up into the form of a non-hollow (full bodied) roll.

The tobacco filter of the present invention may be obtained by a conventional manufacturing process, for instance, by rolling (wrapping) up the sheet material into a rod-form using a conventional paper filter forming machine (e.g. filter plug forming machine). Namely, the tobacco filter in the form of a rod can be manufactured by feeding the sheet material to a funnel of the filter forming machine (wrapping machine) and wrapping up the material to an intentional circumferential length. In the manufacture of the tobacco filter, the creped or embossed sheet material is usually set in a funnel, wrapped up with wrapping tissue or paper into a rod or cylinder having a round cross section, glued and cut to length to provide tobacco filters or filter plugs. In wrapping, the creped sheet-like material is practically wrapped in a direction substantially perpendicular to the lengthwise direction of the creases or wrinkles. In such wrapping of the sheet material, a particulate activated carbon may be incorporated as necessary to provide a tobacco filter or filter plug containing such activated carbon.

The firmness (hardness) of the tobacco filter or filter plug (for example, using the filter material comprising the cellulose ester short staple having the modified cross section), as evaluated in the evaluation method as mentioned hereafter, is for example not more than 1 mm, preferably about 0.5 to 0.95 mm (e.g. about 0.6 to 0.93 mm) and particularly about 0.7 to 0.93 mm.

Filter firmness: A dead weight of a cylindrical form measuring 12 mm in diameter and weighing 300 g is placed on the 100 mm-long filter specimen, and amount of depression (mm) of the filter is determined after 10 seconds.

In the manufacture of tobacco filters or filter plugs, where the gluing along edges of the wrapping paper formed into a rod and gluing between the rod-shaped filter material and wrapping paper are necessary, the water-soluble adhesive as mentioned above is preferably used as the glue in order that the wet disintegratability will not be adversely affected.

The tobacco according to the present invention is provided or equipped with the tobacco filter or filter tip mentioned above. The tobacco filter or filter tip may be arranged in any position or place of the tobacco, and in the tobacco as produced with the wrapping paper into the form of a rod or cylinder, it is practically arranged in a position about the mouth or a position between the mouth and the cigarette.

Since the tobacco filter material according to the present invention comprises the cellulose ester short staple and is in the form of a sheet having a web structure, and the cellulose ester short staple is a short staple being non-crimped and/or having a specific modified cross section, the tobacco filter material and the tobacco filter as produced using the same are excellent in smoking quality and filtrating properties of harmful components (e.g. selective eliminating properties for phenols) and are highly disintegratable when wetted, thus reducing the potential environmental pollution. Moreover, despite the high dry paper strength, they disintegrate or decompose themselves readily and rapidly when wetted. Furthermore, where the cellulose ester short staple has a specific modified cross section, an adequate firmness or hardness can be imparted to the tobacco filter.

The tobacco filter of the present invention which comprises the tobacco filter material is satisfactory in firmness and hence deformation of the filter when held in a mouth can be prevented or inhibited. Further, it insures excellent flavor, aroma and palatability of tobacco smoke, and meritorious filtration properties of harmful components of tobacco smoke, and is highly wet disintegratable and, hence, contributes to mitigation of the environmental pollution.

As the tobacco according to the present invention is provided with the tobacco filter mentioned above, it insures excellent smoking quality and is highly disintegratable in the environment and hence contributory to reducing the risk of potential pollution. Moreover, the tobacco of the present invention, in one embodiment, has an adequate firmness or hardness for tobacco, and, hence, insures excellent smoking feeling (puffing qualities).

The following examples are intended to describe this invention in further detail and should by no means be construed as defining the scope of the invention.

EXAMPLES

The weight, tensile strength, freeness, water disintegratability and filter firmness data shown in the examples and comparative examples were evaluated by the following methods.

Weight (g/m$^2$): Japanese Industrial Standards (JIS) P-8121

Tensile strength (kg/15 mm): JIS-P-8113, 15 mm-wide specimens.

Schopper-Riegler freeness (°SR): JIS-P-8121

Water disintegratability (%): About 0.2 g of a sample was put in 200 ml of water in a 300 ml-beaker (75 mm in diameter) and stirred with a magnetic stirrer so that the center height of the vortex would be equal to ¾ of the highest liquid level. After 10 minutes and 20 minutes, disintegration of the sample was observed, and water disintegratability was evaluated according to the following criteria of 5 levels.

Evaluation criteria;

A: The sample completely disintegrated itself after 10 minutes

B: The sample did not completely disintegrated itself and a non-disintegrated portion (mass or flocculus) remained after 10 minutes but it disintegrated itself entirely after 20 minutes C: Even after 20 minutes, a non-disintegrated portion remained, or a mass remained due to re-aggregation or others although the shape of the sample disintegrated D: Not less than 50% of the sample remained without disintegration, or not less than 50% of the sample remained as a mass despite that the shape of the sample was disintegrated, even after 20 minutes E: Scarcely any sample disintegrated itself even after 20 minutes; original shape retained Smoking quality test: A sample which had been shaped into a filter plug was attached to a cigarette [an entity obtained by removing a filter plug from a cigarette on the market (trade name: Hi-lite, manufactured by Japan Tobacco Inc.)], and using such sample, the smoking quality test was conducted employing 5 habitual smokers as subjects and the aroma (taste) and palatability were evaluated in accordance with the following criteria. The aroma and palatability grade of the sample was shown as a mean value of the evaluation values of the 5 subjects.

Evaluation criteria;

Aroma and palatability grade 3: The tobacco smoke through the sample has no hot (pungent) taste (aroma) and is palatable as a tobacco Aroma and palatability grade 2: The tobacco smoke has no pungent taste but is not so palatable Aroma and palatability grade 1: The tobacco smoke has a pungent taste Filter firmness: A dead weight of a cylindrical form measuring 12 mm in diameter and weighing 300 g was placed on the 100 mm-long filter specimen, and amount of depression (mm) of the filter was determined after 10 seconds. The filter firmness was indicated as a mean value of 3 data as determined in 3 points in the lengthwise direction of the filter in order to exclude an influence due to heterogeneity (ununiformity) in the filter.

EXAMPLES 1 to 6

Sixty (60) parts by weight of a non-crimped cellulose acetate short staple fiber with a cross section shown in Table 1 (fineness of 3 deniers, fiber length of 4 mm, degree of substitution of 2.45) and 40 parts by weight of a bleached soft wood kraft pulp with a beating degree (Schopper-Riegler freeness) of 40° SR were uniformly dispersed in 300,000 parts by weight of water and using the resultant slurry, a web was wetfabricated with a paper-making machine provided with a round net (cylinder paper-making machine). This web was dehydrated and dried to provide sheet materials each weighing 30 g/m$^2$ and measuring 270 mm in width. The water disintegratabilities of these sheet materials were investigated and all of the materials showed excellent water disintegratabilities of level"A".

Each of these sheet materials was creped using a creping roll (surface temperature 140° C., groove pitch 2.0 mm, groove depth 0.6 mm) at a rate of 100 m/minute, and the creped material was worked up at a rate of 150 m/minute to provide a tobacco filter measuring 100 mm long by 24.5 mm in circumference. The firmness of the obtained filters are set forth in Table 1.

COMPARATIVE EXAMPLES 1 to 5

Sixty (60) parts by weight of a crimped cellulose acetate short staple fiber with a cross section shown in Table 1 (fineness of 3 deniers, fiber length of 4 mm, degree of substitution of 2.45) and 40 parts by weight of a bleached soft wood kraft pulp with a beating degree (Schopper-Riegler freeness) of 40° SR were uniformly dispersed in 300,000 parts by weight of water and using the resultant slurry, a web was wet-fabricated with a paper-making machine provided with a round net (cylinder paper-making machine). This web was dehydrated and dried to provide sheet materials each weighing 30 g/m$^2$ and measuring 270 mm in width. The water disintegratabilities of these sheet materials were investigated and all of the materials showed poor water disintegratabilities of level "D".

Each of these sheet materials was creped using a creping roll (surface temperature 140° C., groove pitch 2.0 mm, groove depth 0.6 mm) at a rate of 100 m/minute, and the creped material was worked up at a rate of 150 m/minute to provide a tobacco filter measuring 100 mm long by 24.5 mm in circumference. The firmness of the obtained filters are set forth in Table 1.

TABLE 1

| | Cross-sectional configuration | D1/D2 | Firmness (mm) |
|---|---|---|---|
| Example 1 | Y-cross section | 3.9 | 0.83 |
| Example 2 | Y-cross section | 2.3 | 0.91 |
| Example 3 | X-cross section | 3.3 | 0.85 |
| Example 4 | X-cross section | 2.4 | 0.93 |
| Example 5 | H-cross section | 3.4 | 0.84 |
| Example 6 | I-cross section | 3.8 | 0.95 |
| Comp. Ex. 1 | Circular cross section | 1.1 | 1.35 |
| Comp. Ex. 2 | R-cross section | 1.7 | 1.25 |
| Comp. Ex. 3 | Y-cross section | 1.5 | 1.18 |
| Comp. Ex. 4 | X-cross section | 1.4 | 1.20 |
| Comp. Ex. 5 | Rectangle cross section | 1.5 | 1.30 |

As apparent from Table 1, when the cellulose ester short staple with a configuration where the ratio D1/D2 of diameter D1 of the circumscribed circle relative to the diameter D2 of the inscribed circle of not less than 2 was employed, the resultant filters showed excellent firmness of not more than 1 mm. As for the smoking quality of tobacco smoke, all of the filters indicated the aroma and palatability grade of not less than "2". As a tendency, the greater the ratio D1/D2 of the diameter D1 of the circumscribed circle to the diameter D2 of the inscribed circle was, the higher was the aroma and palatability grade.

COMPARATIVE EXAMPLE 6

A bundle of cellulose acetate fibers (fineness of short staple of 3 deniers, total fineness of 35,000 deniers, degree of substitution of 2.45) was shaped with the use of triacetin to provide a filter plug. The firmness, aroma and palatability grade and water disintegratability of the filter plug were evaluated, and the plug showed a firmness of 0.80 mm and an aroma and palatability grade of 2.8, but the water disintegratability was level "E"

COMPARATIVE EXAMPLE 7

By a single use of the bleached soft wood kraft pulp having a degree of beating of 40° SR as used in Examples 1–6 and Comparative Examples 1–5 and no other, a web was wet-fabricated, and was dehydrated and dried to provide a 270 mm-wide sheet material weighing 30 g/m$^2$. The water disintegratability of this sheet material was level "B".

The sheet material was creped with the use of a creping roll (surface temperature of 140° C., groove pitch of 2.0 mm, groove depth of 0.6 mm) at a speed of 100 m/minute. This creped filter material was worked up at a rate of 150 m/minute to give a filter plug measuring 100 mm long by 24.5 mm in circumference Though the firmness of the filter was 0.95 mm, the aroma and palatability grade of the same was so low of 1.0.

EXAMPLE 7

In 300,000 parts by weight of water were uniformly dispersed 70 parts by weight of the cellulose acetate short staple used in Example 1 and 30 parts by weight of the bleached soft wood kraft pulp with a degree of beating of 40° SR used in Example 1, and the resulting slurry was wet-webbed to give a web. The web was dehydrated and was sprayed with an aqueous solution containing 5% by weight of carboxymethylcellulose in a proportion of 3% by weight, on a dry weight basis, relative to the total amount of the cellulose ester short staple and the bleached soft wood kraft pulp. The sprayed web was dehydrated and dried to provide a 270 mm-wide sheet material weighing 30 g/m$^2$. The sheet material showed a water disintegratability of level "B".

The obtained sheet material was creped by using a creping roll (surface temperature of 140° C., groove pitch of 2.0 mm, groove depth of 0.6 mm) at a speed of 100 m/minute. The creped material was worked up at a rate of 150 m/minute to give a filter plug measuring 100 mm long by 24.5 mm in circumference. The filter showed a firmness of 0.93 mm and an aroma and palatability grade of 2.4.

EXAMPLE 8

To 80 parts by weight of the cellulose acetate short staple as used in Example 1 was added 20 parts by weight of the bleached soft wood kraft pulp with a degree of beating of 40° SR employed in Example 1. The resultant mixture was sprayed to a net by means of air flow and, concurrently, an aqueous solution containing 5% by weight of carboxymethylcellulose was sprayed to the mixture on the net in a proportion of, on a dry basis, 5% by weight relative to the total weight of the mixture to provide a 270 mm-wide sheet material weighing 35 g/m$^2$. The water disintegratability of the sheet-like filter material was level "B".

The obtained sheet material was creped by using a creping roll (surface temperature of 140° C., groove pitch of 2.0 mm, groove depth of 0.6 mm) at a speed of 100 m/minute. The creped material was worked up at a rate of 150 m/minute to give a filter measuring 100 mm long by 24.5 mm in circumference. The firmness and the aroma and palatability grade of the filter were 0.90 mm and 2.8, respectively.

EXAMPLE 9

In 300,000 parts by weight of water were homogeneously dispersed 60 parts by weight of a non-crimped cellulose acetate propionate short staple (fineness of 3 deniers, fiber length of 4 mm, degree of substitution with acetate of 2.45, degree of substitution with propionate of 0.40) of Y-cross section (diameter D1 of the circumscribed circle/diameter D2 of the inscribed circle=3.8) and 40 parts by weight of a bleached soft wood kraft pulp with a degree of beating of 40° SR. By using the resulting slurry, a web was wet-fabricated, and this web was dehydrated and dried to provide a sheet material weighing 30 g/m$^2$ and measuring 270 mm in width. The sheet material showed a water disintegratability of level"A".

The sheet material was creped with the use of a creping roll (surface temperature of 140° C., groove pitch of 2.0 mm, groove depth of 0.6 mm) at a speed of 100 m/minute. The creped material was worked up at a rate of 150 m/minute to give a filter plug measuring 100 mm long by 24.5 mm in circumference. The filter showed a firmness of 0.92 mm and an aroma and palatability grade of 2.4.

EXAMPLE 10

A non-crimped cellulose acetate short staple (Y-cross section, D1/D2=3.9, fiber length of 4 mm, substitution degree of 2.45) (3.0 g) and a bleached soft wood kraft pulp with a beating degree of 40° SR (2.0 g) were put into 495 g of water in a 1-liter beaker (110 mm in diameter). The resultant mixture was stirred forcedly at a rate of 600 rpm for 20 minutes using a stirring blade (9 cm in diameter) to give a uniform slurry where fibers were dispersed homogeneously.

The slurry was diluted with water to 30 times as much as original and, thereby, a web was wet-fabricated using the diluted slurry. The obtained web was dehydrated and dried to give a sheet material having a web structure with a good formation.

COMPARATIVE EXAMPLE 8

In 495 g of water in a 1-liter beaker (110 mm in diameter) were put 3.0 g of a cellulose acetate short staple with a degree of crimping of 20 crimps per inch (Y-cross section, D1/D2=1.5, fineness of 3 deniers, fiber length of 4 mm, degree of substitution of 2.45) and 2.0 g of a bleached soft wood kraft pulp with a degree of beating of 40° SR. The mixture was stirred forcedly at a rate of 600 rpm for 20 minutes with the use of a stirring blade (9 cm in diameter), and, as a result, fibers were interlaced with each other so that a uniform slurry could not be obtained. Therefore, when the slurry mixture was diluted with water by a factor of 30 times and a web was formed according to wet webbing with the use of the diluted slurry mixture, a sheet material having a web structure with good formation failed to be obtained.

EXAMPLES 11 to 22

By using 60 parts by weight of a non-crimped cellulose acetate short staple with a fiber length shown in Table 2 (Y-cross section, D1/D2=3.9, fineness of 3 deniers, substitution degree of 2.45) and 40 parts by weight of a bleached soft wood kraft pulp with a degree of beating shown in Table 2, a web was wet-fabricated in accordance with the technique described in JIS-P-8209. The web was dehydrated and dried to give a sheet material having a web structure.

EXAMPLES 23 to 25

With the use of 60 parts by weight of a noncrimped cellulose acetate short staple with a fiber length shown in Table 2 (fineness of 3 deniers, substitution degree of 2.45) and 40 parts by weight of a bleached soft wood kraft pulp with a degree of beating shown in Table 2, a web was wet-fabricated in accordance with the technique described in JIS-P-8209. The web was dehydrated and dried to give a sheet material having a web structure.

The cross sectional configurations of the non-crimped cellulose acetate short staples used in each Example were R-configuration (D1/D2=1.7) for Example 23, I-configuration (D1/D2=3.8) for Example 24 and X-configuration (D1/D2=3.3) for Example 25.

COMPARATIVE EXAMPLES 9 to 11

A web was wet-fabricated according to the technique described in JIS-P-8209using 60 parts by weight of a crimped cellulose acetate short staple with a degree of crimping shown in Table 3 (fiber length of 4 mm, Y-cross section, D1/D2=1.5, fineness of 3 deniers, degree of substitution of 2.45) and 40 parts by weight of a bleached soft wood kraft pulp with a degree of beating of 40° SR. This web was dehydrated and dried to give a sheet material having a web structure.

The characteristics of the sheet materials obtained in Examples 11 to 25 and Comparative Examples 9 to 11 were evaluated. The results are shown in Table 2 and Table 3.

TABLE 2

| | Fiber length (mm) | Degree of beating (SR) | Weight (g/m$^2$) | Tensile strength (kg/15 mm) | Water disintegratability |
|---|---|---|---|---|---|
| Example 11 | 4 | 10 | 32 | 0.19 | A |
| Example 12 | 4 | 20 | 31 | 0.32 | A |
| Example 13 | 4 | 30 | 31 | 0.38 | A |
| Example 14 | 4 | 40 | 32 | 0.47 | A |
| Example 15 | 4 | 50 | 32 | 0.57 | A |
| Example 16 | 4 | 60 | 31 | 0.62 | B |
| Example 17 | 4 | 70 | 33 | 0.73 | B |
| Example 18 | 4 | 80 | 33 | 0.72 | C |
| Example 19 | 2 | 40 | 32 | 0.31 | A |
| Example 20 | 6 | 40 | 31 | 0.53 | A |
| Example 21 | 8 | 40 | 33 | 0.62 | A |
| Example 22 | 10 | 40 | 31 | 0.71 | C |
| Example 23 | 4 (R-cross section) | 40 | 31 | 0.40 | A |
| Example 24 | 4 (I-cross section) | 40 | 31 | 0.52 | A |
| Example 25 | 4 (X-cross section) | 40 | 32 | 0.48 | A |

TABLE 3

| | Degree of crimping (crimps/inch) | Weight (g/m$^2$) | Tensile strength (kg/15 mm) | Water disintegratability (%) |
|---|---|---|---|---|
| Comp. Ex. 9 | 20 | 33 | 0.20 | D |
| Comp. Ex. 10 | 10 | 31 | 0.22 | D |
| Comp. Ex. 11 | 5 | 32 | 0.28 | D |

As clearly shown in Tables 2 and 3, the sheet materials obtained in Examples 11 to 25 exhibited excellent water disintegratability, while, as a tendency, the smaller degree of beating of the pulp was, the lower did tensile strength of the sheet become, and the longer the fiber strength of the short staple was, the lower did the water disintegratability become. Contrary to this, the sheet materials as produced using crimped short staples in Comparative Examples 9 to 11 were low in dispersibility in water, even when the concentration of solid matters in slurry was low, for example, according to the technique described in JIS-P-8209. Therefore, the formation and strength of the sheet were deteriorated (as compared with Example 14), and the water disintegratability was remarkably sacrificed.

EXAMPLE 26

By using the same composition as in Example 14, the non-crimped cellulose acetate short staple with a fiber length of 4 mm and the bleached soft wood kraft pulp with a degree of beating of 40° SR were subjected to wet web-formation with the use of a cylinder paper-making machine to give a sheet-like tobacco filter material weighing 30 g/m$^2$ and measuring 270 mm in width. This sheet material showed a tensile strength in the lengthwise direction of 1.20 kg/15 mm and a water disintegratability of level"A".

The obtained sheet material was subjected to creping treatment with the use of a creping roll (surface temperature of 140° C., groove pitch of 2.0 mm, groove depth of 0.6 mm) at a speed of 100 m/minute. The creped sheet material was worked up at a rate of 50 m/minute to provide a filter plug measuring 100 mm long by 24.5 mm in circumference. This filter plug was cut to a suitable length and subjected to the smoking quality test. As a result, the filter plug showed an aroma and palatability grade of 2.6.

EXAMPLE 27

By using the non-crimped cellulose acetate short staple with a fiber length of 4 mm and the bleached soft wood kraft pulp in the same proportions as used in Example 14, a web was wet-fabricated using a cylinder paper-making machine. The web was dehydrated and was sprayed with an aqueous solution containing 5% by weight of carboxymethylcellulose, in a proportion of 3% by weight on a dry basis relative to the web. The sprayed web was dried to provide a 270 mm-wide sheet material weighing 30 g/m$^2$. The tensile strength in the lengthwise (longitudinal) direction of the sheet-like material was 1.50 kg/15 mm and the water disintegratability was level "B".

A filter plug (100 mm in length, 24.5 mm in circumference) was obtained in the same manner as in Example 26 except that the sheet material obtained above was employed. The filter plug was cut to a suitable length and the smoking quality test was effected using this filter plug. Resultantly, the aroma and palatability grade for the filter plug was 2.6.

EXAMPLE 28

A 270 mm-wide sheet material weighing 30 g/m$^2$ was obtained by wet webbing with the use of a cylinder paper-making machine, and employing the same composition as Example 11 comprising the non-crimped cellulose ester short staple and the bleached soft wood kraft pulp. The sheet material showed a tensile strength in the lengthwise direction of the sheet of 0.45 kg/15 mm and a water disintegratability of level"A".

Using a creping roll (surface temperature of 140° C., groove pitch of 2.0 mm, groove depth of 0.6 mm), was creped the sheet material at a speed of 20 m/minute. The creped material was worked up at a rate of 30 m/minute to provide a filter plug measuring 100 mm long by 24.5 mm in circumference. This filter plug was cut to an adequate length and subjected to the smoking quality test, and hence, it manifested an aroma and palatability grade of 2.4.

EXAMPLE 29

A 270 mm-wide sheet-like filter material weighing 30 g/m$^2$ was obtained in the same manner as in Example 26 except that the non-crimped cellulose acetate short staple was used in an amount of 40 parts by weight and the bleached soft wood kraft pulp was employed in a proportion of 60 parts by weight. The tensile strength in the lengthwise direction of the sheet was 1.90 kg/15 mm and the water disintegratability was level"A".

The sheet material was creped with the use of a creping roll (surface temperature of 140° C., groove pitch of 2.0 mm, groove depth of 0.6 mm) at a rate of 100 m/minute. The creped sheet material was worked up at a rate of 150 m/minute to provide a filter plug measuring 100 mm long by 24.5 mm in circumference. This filter plug was cut to a suitable length as tobacco filter and the smoking quality test was conducted using the same. As a result, the aroma and palatability grade was 2.2 for the filter plug.

EXAMPLE 30

Using 60 parts by weight of a cellulose acetate propionate short staple (Y-cross section, D1/D2=3.6, fineness of 3 deniers, fiber length of 4 mm, substitution degree for acetic acid of 2.45, substitution degree for propionic acid of 0.40) and 40 parts by weight of a bleached soft wood kraft pulp with a beating degree of 40° SR, a web was wet-fabricated with the use of a cylinder paper-making machine to give a sheetlike filter material weighing 30 g/m$^2$ and measuring 270 mm in width. The sheet material indicated a tensile strength in the lengthwise direction of the sheet of 1.25 kg/15 mm and a water disintegratability of level "A".

The obtained sheet material was creped at a speed of 100 m/minute using a creping roll (surface temperature of 140° C., groove pitch of 2.0 mm, groove depth of 0.6 mm). The resultant creped sheet material was worked up at a rate of 150 m/minute to provide a filter plug. The filter plug was cut to a suitable length and, thereby, subjected to the smoking quality test. Resultantly, the aroma and palatability grade for the filter plug was 2.4.

COMPARATIVE EXAMPLE 12

The aroma and palatability grade and water disintegratability for a conventional filter plug as produced by shaping a fiber bundle of cellulose acetate fibers (degree of substitution of 2.45) with triacetin were rated. As a result, the filter plug showed an aroma and palatability grade of 2.8, and such low water disintegratability of level "E" that the plug did not disintegrate itself at all, that is, original shape of the same retained.

COMPARATIVE EXAMPLE 13

By using the bleached soft wood kraft pulp with a beating degree of 40° SR as used in Example 14 and no other, a 270 mm-wide sheet material weighing 30 g/m$^2$was obtained in accordance with wet fabrication technique. The tensile strength in the longitudinal direction of the sheet material was 3.50 kg/15 mm and the water disintegratability of the same was level "B".

The sheet material was subjected to creping treatment with the use of a creping roll (surface temperature of 140° C., groove pitch of 2.0 mm, groove depth of 0.6 mm) at a rate of 100 m/minute. The creped sheet material was worked up or rolled up at a rate of 150 m/minute to give a filter plug of 100 mm in diameter and 24.5 mm in circumference. The filter plug was cut to a predetermined length to provide filter tips and the smoking quality test for the plug was carried out. Resultantly, the aroma and palatability grade of the plug was so low of 1.0.

What is claimed is:

1. A tobacco filter material in the form of a sheet having a web structure and comprising a cellulose ester short staple, wherein said cellulose ester short staple is:

(1) a cellulose ester short staple having a modified cross section, wherein the ratio of a diameter D1 of a circumscribed circle of the cross section of said short staple relative to the diameter D2 of an inscribed circle of said cross section is such that the former D1/the latter D2 is not less than 2.

2. A tobacco filter material as claimed in claim 1, wherein the sectional configuration of said cellulose ester short staple is in X-, Y- H- or I-configuration.

3. A tobacco filter material as claimed in claim 1, wherein said ratio D1/D2 is 2.2 to 6.

4. A tobacco filter material as claimed in claim 1, wherein said cellulose ester is an ester with an organic acid having 2 to 4 carbon atoms.

5. A tobacco filter material as claimed in claim 1, wherein said cellulose ester is a cellulose acetate having an average degree of substitution of 1.5 to 3.0.

6. A tobacco filter material as claimed in claim 1, which further comprises a beaten pulp.

7. A tobacco filter material as claimed in claim 6, wherein said beaten pulp is a wood pulp.

8. A tobacco filter material as claimed in claim 6, wherein the proportion of said cellulose ester short staple to said beaten pulp is 90/10 to 20/80 (by weight).

9. A tobacco filter material as claimed in claim 6, wherein said cellulose ester short staple is a short staple having a mean fiber length of 1 to 10 mm and a fiber fineness of 1 to 10 deniers, the degree of beating of said beaten pulp is a Schopper-Riegler freeness of 20 to 90° SR.

10. A tobacco filter material as claimed in claim 1, which further comprises a binder.

11. A tobacco filter material as claimed in claim 1, which is creped or embossed.

12. A tobacco filter material as claimed in claim 11, wherein the pitch and depth of grooves for creping and the pitch and depth of an embossing pattern are 0.3 to 5 mm for pitch and 0.1 to 2 mm for depth.

13. A tobacco filter material as claimed in claim 1, which has a web structure obtainable by wet webbing.

14. A tobacco filter material as claimed in claim 1, wherein said cellulose ester short staple is a non-crimped cellulose ester short staple.

15. A tobacco filter material in the form of a sheet comprising a cellulose acetate short staple having a mean fiber length of 2 to 8 mm, a fiber fineness of 2 to 8 deniers and an average degree of substitution of 1.5 to 3.0, and a beaten wood pulp having a degree of beating of a Schopper-Riegler freeness of 20 to 80° SR in a proportion of such that the former/the latter is 80/20 to 30/70 (by weight), wherein said cellulose acetate short staple is:

(1) a cellulose acetate short staple having a modified cross section where the ratio of a diameter D1 of a circumscribed circle of the cross section of said short staple relative to a diameter D2 of an inscribed circle of said cross section is such that the former D1/the latter D2 is 2.3 to 5.

16. A tobacco filter material as claimed in claim 15, which further comprises a water-soluble binder.

17. A tobacco filter material as claimed in claim 16, wherein the proportion of said water-soluble binder as a dry basis is 0.1 to 10% by weight based on the total amount of the filter material.

18. A tobacco filter which comprises a filter material in the form of a sheet, where said filter material has a web structure and comprises a cellulose ester short staple, wherein said cellulose ester short staple is:

(1) a cellulose ester short staple having a modified cross section, wherein the ratio of a diameter D1 of a circumscribed circle of the cross section of said short staple relative to a diameter D2 of an inscribed circle of said cross section is such that the former D1/the latter D2 is not less than 2.

19. A cigarette provided with a tobacco filter as claimed in claim 18.

* * * * *